US005517161A

United States Patent [19]

Andersson et al.

[11] Patent Number: 5,517,161

[45] **Date of Patent: *May 14, 1996**

[54] YIG COMPONENT

[75] Inventors: Ronny Andersson, Tullinge; Gunnar Andersson, Norsborg, both of Sweden

[73] Assignee: Sivers IMA AB, Kista, Sweden

[ * ] Notice: The term of this patent shall not extend beyond the expiration date of Pat. No. 5,428,324.

[21] Appl. No.: 327,677

[22] Filed: Oct. 21, 1994

Related U.S. Application Data

[63] Continuation-in-part of Ser. No. 98,209, Jul. 28, 1993, Pat. No. 5,428,324.

[30] Foreign Application Priority Data

Oct. 2, 1992 [SE] Sweden ..... 9202871

[51] Int. Cl.[6] ..... H01P 1/218

[52] U.S. Cl. ..... 333/202; 331/96; 333/219.2

[58] Field of Search ..... 333/148, 201, 333/202, 219, 219.2, 235; 331/67, 68, 96, 107 DP, 117 D

[56] References Cited

U.S. PATENT DOCUMENTS

| | | | |
|---|---|---|---|
| 4,484,161 | 11/1984 | Barger | 333/202 |
| 4,605,911 | 8/1986 | Jin | 333/148 X |
| 4,651,116 | 3/1987 | Schloemann | 333/202 |
| 5,115,209 | 5/1992 | Grace et al. | 331/49 |

FOREIGN PATENT DOCUMENTS

| | | | |
|---|---|---|---|
| 152804 | 6/1989 | Japan . | |
| 280602 | 12/1991 | Japan | 333/219.2 |
| 2161653 | 1/1986 | United Kingdom | 333/202 |

*Primary Examiner*—Paul Gensler
*Attorney, Agent, or Firm*—Christie, Parker & Hale

[57] ABSTRACT

A YIG component for providing a microwave frequency output signal has a cavity holding an electromagnetic circuit defining an air gap between a pair of pole pins. The cavity having a tuning coil for generating a homogeneous magnetic field in the air gap, and further holding a YIG unit comprising a carrier; at least one ferrite crystal arranged in the air gap; and an interface connected to the ferrite crystal or crystals for providing the microwave frequency output signal. A magnetic core is included in the electromagnetic circuit and comprises the pole pins combined with magnetic flux closing path elements shaped as bars, the pole pins and the bar-shaped elements forming an open structure. The YIG component includes a support housing made of a nonmagnetic material having formed therein the above-mentioned cavity and having inside the cavity integral precision-tooled surfaces for the carrying and relative positioning of the electromagnetic circuit and the YIG unit. The surfaces comprise a first positioning seat for the magnetic core and a second positioning seat for the carrier, the core and the carrier being thus supported separately by the support housing.

13 Claims, 6 Drawing Sheets

YIG COMPONENT

CROSS REFERENCE

This application is a continuation-in-part of U.S. application Ser. No. 08/098,209, filed Jul. 28, 1993, now U.S. Pat. No. 5,428,324, which in turn claims priority of Swedish Application No. 9202871-1, filed Feb. 10, 1992.

BACKGROUND OF THE INVENTION

This invention is directed to YIG components in general and more specifically to a YIG component comprising a magnetic circuit for generating an homogeneous magnetic field in an air gap of the magnetic circuit, and at least one ferrite crystal arranged in said air gap and having a magnetic resonance frequency which may be controlled dependent on the strength of said homogeneous magnetic field.

"YIG components" is a generic term for devices using ferrite crystals, that is thin layers or crystals of YIG (yttrium-iron-garnet), LiF (lithium-ferrite) NiZnFe (nickel-zinc-ferrite), etc., as resonators in, for example, electric oscillators, filters and discriminators. YIG components are used in high frequency applications for frequencies from about 500 MHz and upwards. Electromagnetic frequencies in this range are often denoted "microwaves" and electric circuits operating at these frequencies are denoted "microwave circuits" hereinafter.

In order to be able to provide a resonator using a ferrite crystal, a strong, homogeneous magnetic field is required in which the ferrite crystal is arranged. The magnetic field is generated by a magnetic circuit comprising an electromagnet or a permanent magnet in combination with a magnetic iron structure. The magnetic resonance frequency of the resonator is directly proportional to the strength of the magnetic field. It follows from this that when using an electromagnet, the resonance frequency of a YIG component may be controlled electrically via the current through said electromagnet. The ferrite resonator has a number of good features and is characterized by a high Q-value and in that it can be controlled electrically within very broad frequency ranges (several octaves).

The majority of prior-art YIG components have a design in which the electromagnet completely or partly constitutes the housing and carrier for the remaining components, such as said ferrite crystal, microwave circuits etc., required to make up the intended YIG component. Because magnetic iron is a material which is difficult to work, the intention has been to provide an uncomplicated mechanical structure for the YIG component. An example of a prior-art YIG component is shown in JP 1-152804 (to Uehara). The YIG component comprises a magnetic circuit including an electromagnet having a magnetic core forming a box-shaped housing (13, 13*a*) of a two-part structure, the two parts being identical. Each part has a pole pin (16, 16*a*) surrounded by a coil (25, 25*a*). The pole pins define a pole gap in which a YIG element is positioned. The YIG element is included in a magnetostatic wave generator, which is fixed to a carrier (21, 20). The two parts have recesses which form rectangular holes in opposite sides of the housing. When the two parts are joined together to form the housing, the carrier (21, 20) is positioned between them, portions (A, A') thereof filling the holes and being clamped in place by the two magnetic core parts. The housing is enclosed in double outer shells to reduce the temperature sensitivity.

Another prior-art YIG component has a construction in which the magnetic core consists of a cylinder having a bottom, a cap and a central pin or pole pin, extending upwards from the bottom towards the cap and leaving a slot (pole gap) between the upper end of the pin and the cap. A coil is disposed around the pin. The remaining components are mainly arranged in the space defined between the magnetic coil and the cap of the magnetic core and are attached to the cap or the cylinder wall.

The above prior-art constructions have several drawbacks. Above all, they are relatively big, heavy and expensive because the magnetic material is a specific and expensive alloy which is difficult to work. The construction has been gradually minimized but size minimization is limited by the fact that the components which are accommodated therein require a fixed amount of space and by the fact that the resonator must be oriented to the center of the mechanical structure.

The thermal conductivity of magnetic iron is low and this is a disadvantage of the prior-art construction because a relatively high power dissipation from said coil and circuits must be cooled via this material.

Certainly, the prior-art YIG components may be controlled electrically but high inductance in the control coil and troublesome eddy currents have the consequence that changes of frequency are relatively time-consuming, thereby limiting the range of possible applications. The magnetic flux generated by the electromagnet flows through the pole pin (or pins) and through the walls of the housing, which is cylindrical or box-shaped. The magnetic flux thus passes through many parts of different sections and circumferences. When making a current change in order to change the resonance frequency, a flux change results. In that case, eddy currents are induced at each section/ circumference with a varying strength and decay time or time constant dependent on the section/circumference. These eddy currents initiate an exponential delay between tuning current and magnetization (frequency change). This delay may be compensated by a "driver", an electronic circuit for voltage-to-current transformation which is used for enabling the YIG component voltage to be controlled. A magnet of this conventional design initiates about five different time constants, which must be compensated for by an equal number of compensation networks, each of which must be defined in respect of proportionality and time constant in order to counteract said delay effectively.

The conventional magnet design generates a large leakage flux. The optimal situation is when the total magnetic flux passes through the pole gap or air gap between the pole pin and the cap, or pole pins (Uehara), respectively, but in the prior-art construction a significant part deflects away from the pole pin and passes to the walls of the housing outside the pole gap, generating excessive inductance.

Furthermore the conventional YIG components are sensitive to mechanical influences as well as external magnetic fields from fans, motors, etc., which may modulate the resonance frequency. Accordingly, a specific mechanical mounting and an external, magnetic shield of μ-metal arranged around the YIG component, respectively, are often required.

The YIG component is ordinarily used in a microwave system in which a number of electric functions are desirable, and in which the YIG component is intended for cooperation with other YIG components or other units. It follows from this that said components and units must be interconnected by means of external contacts, cables and mechanical devices.

Up to now, the range of application of the YIG components has been limited by the abovementioned drawbacks.

SUMMARY OF THE INVENTION

An object of the invention is to eliminate the drawbacks of the prior art technology and to provide a YIG component which is small, easy to assemble on a circuit board and allows for integration of a number of desirable functions.

It is a further object of the invention to provide a YIG component which is substantially less sensitive to mechanical and magnetic influence in comparison with prior art components, which has substantially only one time constant, and which has a low inductance for obtaining rapid changes of frequency.

The objects of the invention are achieved by means of a YIG component for providing a microwave frequency output signal, comprising:

- a cavity holding electromagnetic circuit means defining an air gap between a pair of pole pins and having a tuning coil for generating a homogeneous magnetic field in said air gap, and further holding a YIG unit comprising a carrier, at least one ferrite crystal arranged in said air gap and having a magnetic resonance frequency which is controllable depending on the strength of the homogeneous magnetic field; and interface means connected to said at least one ferrite crystal for providing said microwave frequency output signal;
- a magnetic core included in said electromagnetic circuit means and comprising said pole pins combined with magnetic flux closing path elements shaped as bars, said pole pins and said bar-shaped elements forming an open structure;
- a support housing made of a nonmagnetic material having formed therein said cavity and having inside said cavity integral precision-tooled surfaces for the carrying and relative positioning of said electromagnetic circuit means and said YIG unit, said surfaces comprising;
- a first positioning seat for said magnetic core; and
- a second positioning seat for said carrier, said core and said carrier being thus supported separately by said support housing.

The YIG component thus obtained according to the invention represents a completely new way of thinking. In a sense, the old construction has been turned inside out. The magnetic core no longer constitutes the housing, but instead a specific housing has been formed enclosing the remaining component parts. This means that the construction may be made substantially smaller and allows greater freedom because the incorporated elements may be positioned fairly much at will in the housing and the magnetic circuit may be made smaller with less regard to the size of the remaining elements. Further, because of the new structure of the YIG component, the housing may be of a different material than the specific alloy mentioned above, allowing it to be shaped with high precision into a complicated structure, in order to ensure that elements requiring an accurate mutual alignment will be positioned correctly when arranged in the housing without time-consuming readjustment.

A preferred embodiment of the invention is characterized in that the modulation coil comprises a printed circuit.

This embodiment has a number of advantages in comparison with prior-art technology, because the magnetic circuit of the YIG component according to the invention may be made small and a very short air gap may be formed. This allows only for a very thin modulation coil. When using a conventional, wire-wound modulation coil in this compact magnetic structure, it has to be positioned outside the air gap, this bringing inferior performance in respect of modulation features in comparison with a conventionally-built YIG component. According to this preferred embodiment of the invention, a modulation coil has been obtained which is adapted to the existing conditions of the YIG component according to the invention and provides for substantially improved modulation features as compared with a conventional-type modulation coil.

BRIEF DESCRIPTION OF THE DRAWINGS

The YIG component according to the invention will be described in greater detail in the form of an exemplary embodiment and with reference to the drawings, in which.

DESCRIPTION OF THE PREFERRED EMBODIMENT

Figure 1:
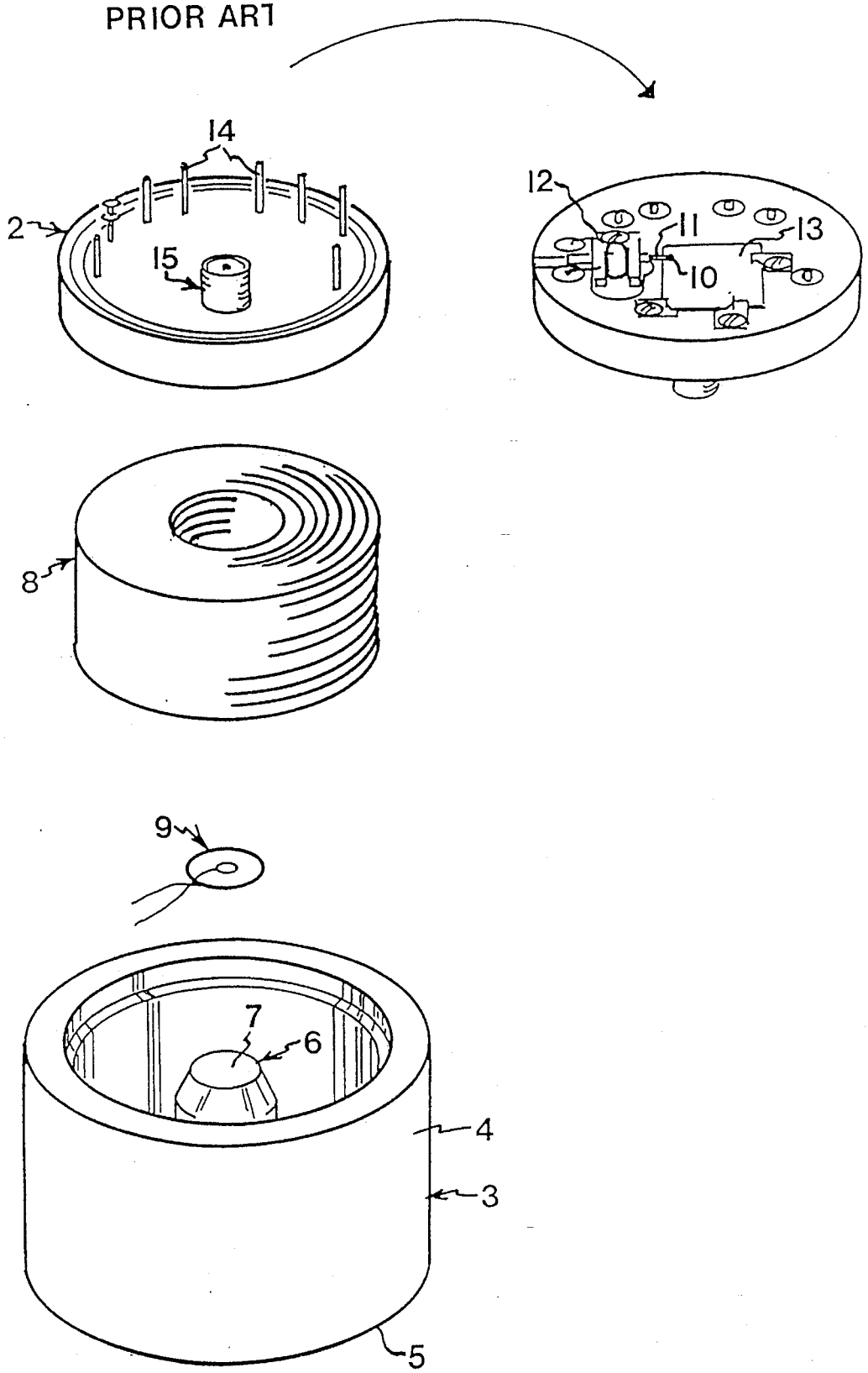
FIG.1 PRIOR ART
FIG. 1 is an exploded view of a conventional-type YIG component.

FIG. 1 discloses a conventional YIG component in the form of a microwave oscillator. In this component, the housing at the same time constitutes the core of an electromagnet. This core has an upper part 2 and a lower part 3, which is an element that has been turned in one piece from a magnetic iron material. The lower part 3 has a cylinder 4, a bottom 5 and a pole pin 6 extending upwards from the bottom 5 in the centre of the cylinder 4. When the component is assembled, an air gap exists between the upper surface 7 of the pole pin 6 and the cap 2. A coil 8, which is a main coil for coarse adjustment of the frequency, is disposed around the pole pin 6. A modulation coil or Fm-coil 9 for fine adjustment is provided in the air gap, the coil being then glue-fastened to the end surface of the pole pin 6. The modulation coil is a sparsely wound coil (usually 25 windings), which is shaped from a thin insulated copper wire. A ferrite crystal in the form of a sphere 10 is positioned in the air gap and disposed on a dielectric rod 11, most often made of a ceramic, for example saphire, and is mounted on a carrier 12. The modulation coil 9 is positioned as close as possible to the ferrite crystal 10. The carrier 12 is fixed to the cap 2 on its inside.

On the inside of the cap 2, a ceramic circuit board 13 comprising microwave electronics is also attached. Connections 14 for voltage supply and control of incorporated components are provided in the cap 2 as well as a microwave connection 15, this being a signal output.

The prior-art component in FIG. 1 operates as follows. A first control current for controlling the main coil 8 and a second control current for controlling the modulation coil 9 are supplied via connections 14. A magnetic flux is then generated by the main coil 8, of which a major part follows the magnetic iron, that is upwards through the pole pin 6, via the air gap to the upper part 2, downwards through the cylinder 4 and the bottom 5, and returns upwards through the pole pin 6. The modulation coil 9 influences the magnetic flux in the air gap between the upper end surface 7 of the pole pin 6 and the cap 2 on which the ferrite crystal 10 is positioned. In the air gap, a homogeneous magnetic field is obtained. The ferrite crystal 10 is such that when positioned in a magnetic field (H-field) of a certain magnitude, a resonance frequency proportional to the H-field is obtained. The resonance may be controlled within a certain frequency range, for example 2–20 GHz. It follows from this that the modulation coil 9 controls the resonance frequency of the resonance element, that is the ferrite crystal 10, within a limited frequency range (deviation) in the vicinity of the frequency which is determined by remaining elements and factors, including the permanent magnet, the main coil, the air gap and the magnetic structure. The ferrite crystal 10 is connected to an electric oscillator circuit on the circuit board 13. The oscillator circuit generates an electric wave (oscillation) having a frequency which corresponds to the resonance frequency of the ferrite crystal 10. Coarse adjustment of the frequency is made by means of the main coil 8 and fine adjustment is made by means of the modulation coil 9. The generated microwave signal is connected to the signal output 15. This prior-art design of the electromagnetic core 1 generates a comparatively large useless flux, that is a magnetic flux which will not pass through the air gap but which will instead flow directly from the pole pin 6 to the cap 2.

When a greater frequency change is to be obtained, the control current to the main coil 8 is first changed and in some cases the frequency is fine-adjusted by changing the control current to the modulation coil 9. When changing the current in said coils, eddy currents are induced in the core of the electromagnet which attempt to counteract the change. Said eddy currents appear predominantly in the surface layer of the magnetic material. The decay time of the eddy currents is proportional to the circumference of the magnetic core transverse to the magnetic flux. The prior-art design of the magnetic core according to FIG. 1 will give rise to substantially five different decay times or time constants in different parts of the magnetic core 1. This entails a comparatively long settling time for the component 10, which, however, may be partly compensated for by means of separate control electronics including a compensation network for each time constant, that is up to five different compensation networks. The considerable useless leakage flux contributes to a large inductance in the component 10. The settling time is also delayed by this large inductance. Additionally, the modulation features of the modulation coil are negatively influenced by said eddy currents.

Figure 2:
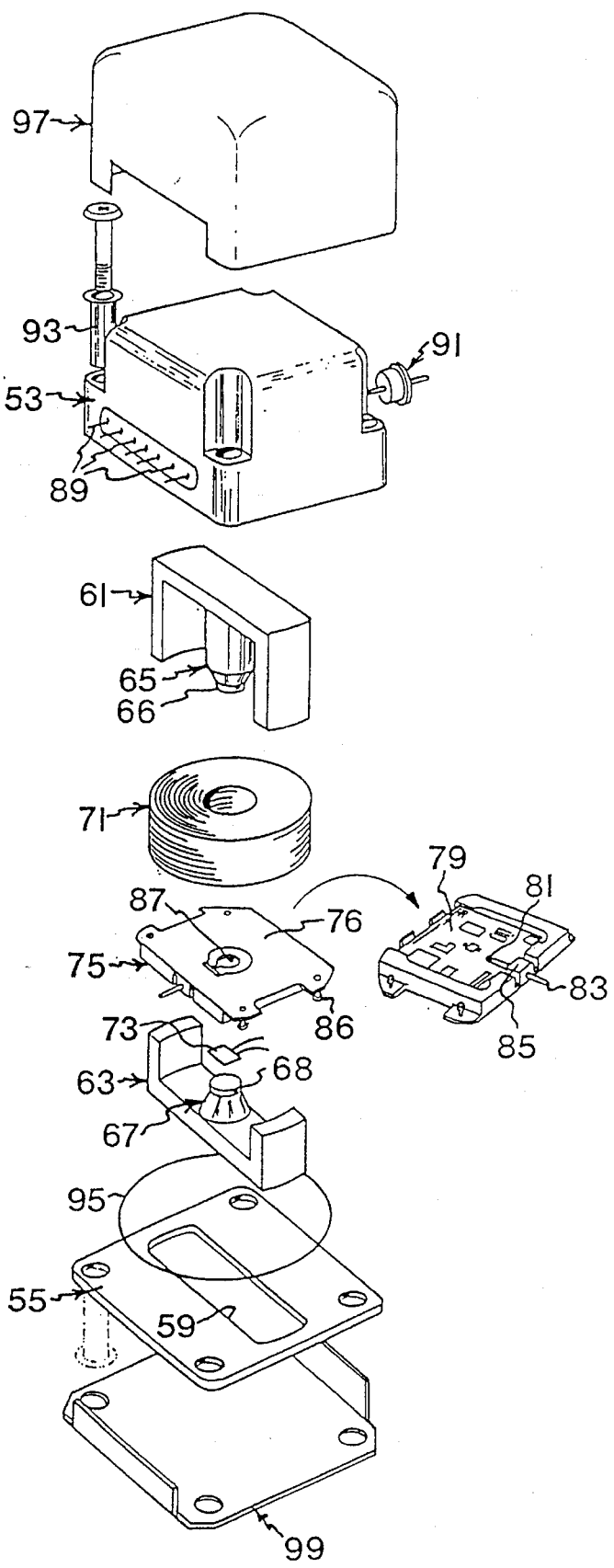
FIG. 2 is an exploded view of an embodiment of a YIG component according to the invention.
Figure 3:
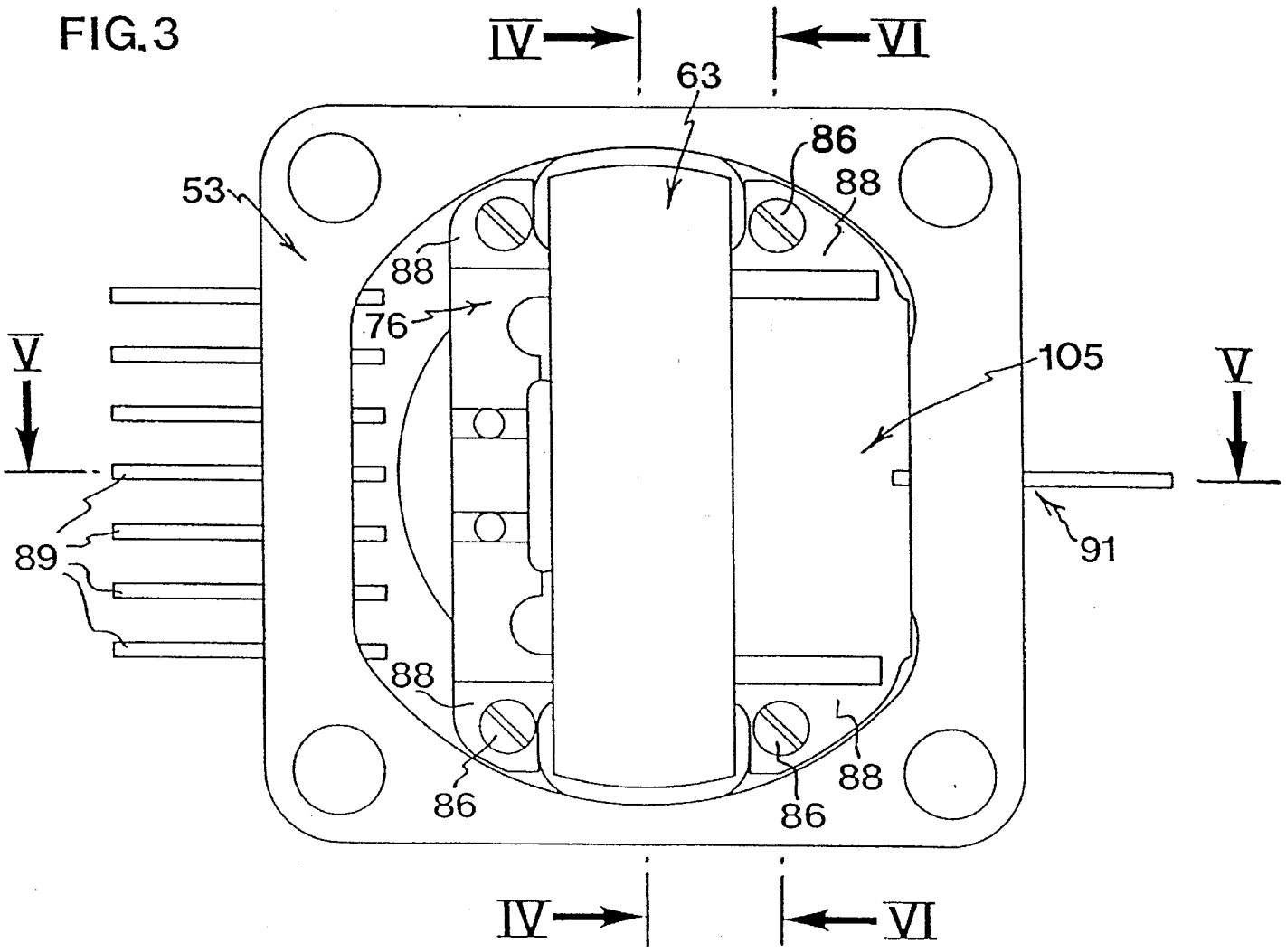
FIG. 3 is a bottom view of the YIG component in FIG. 2 in the assembled state and with its interior exposed.
Figure 4:
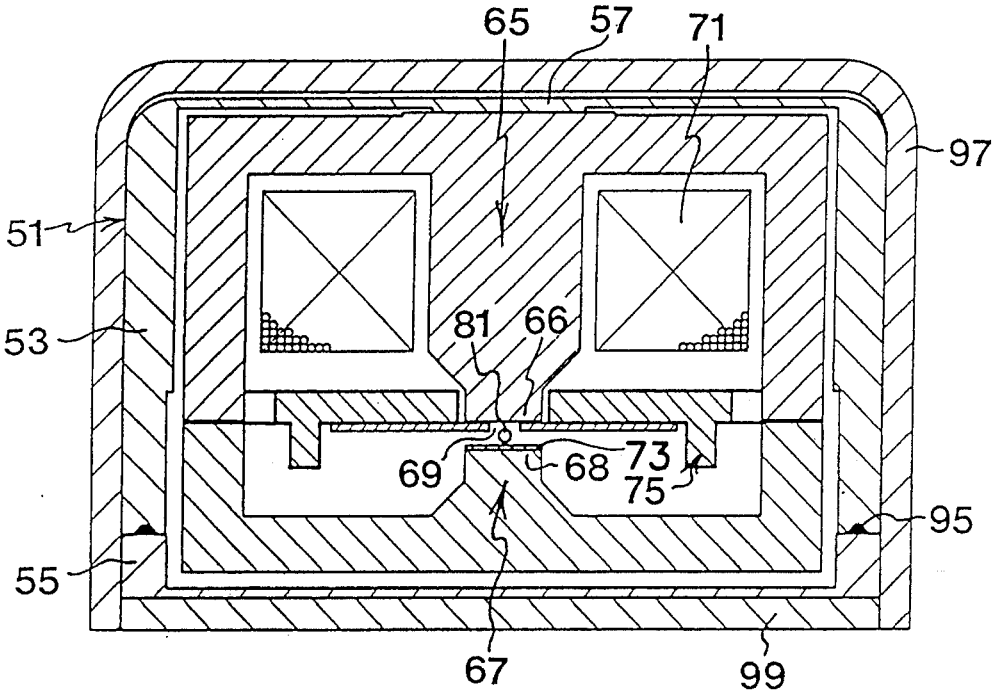
FIG. 4 is a cross-sectional view of the assembled YIG component taken along line IV—IV in FIG. 3.
Figure 5:
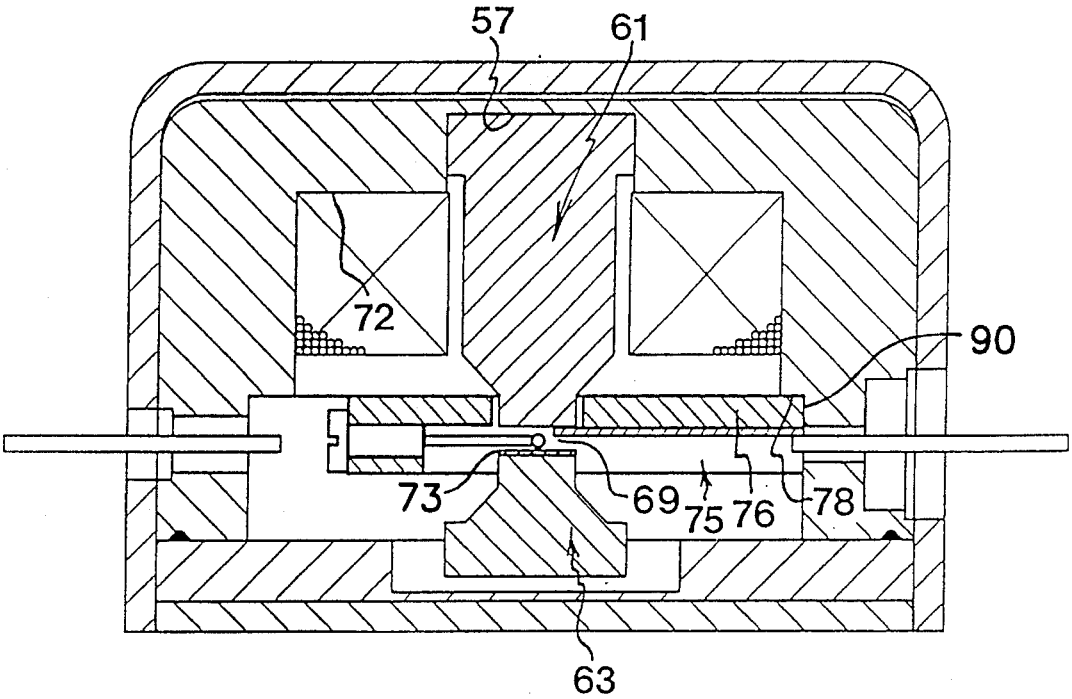
FIG. 5 is a cross-sectional view of the assembled YIG component taken along line V—V in FIG. 3.
Figure 6:
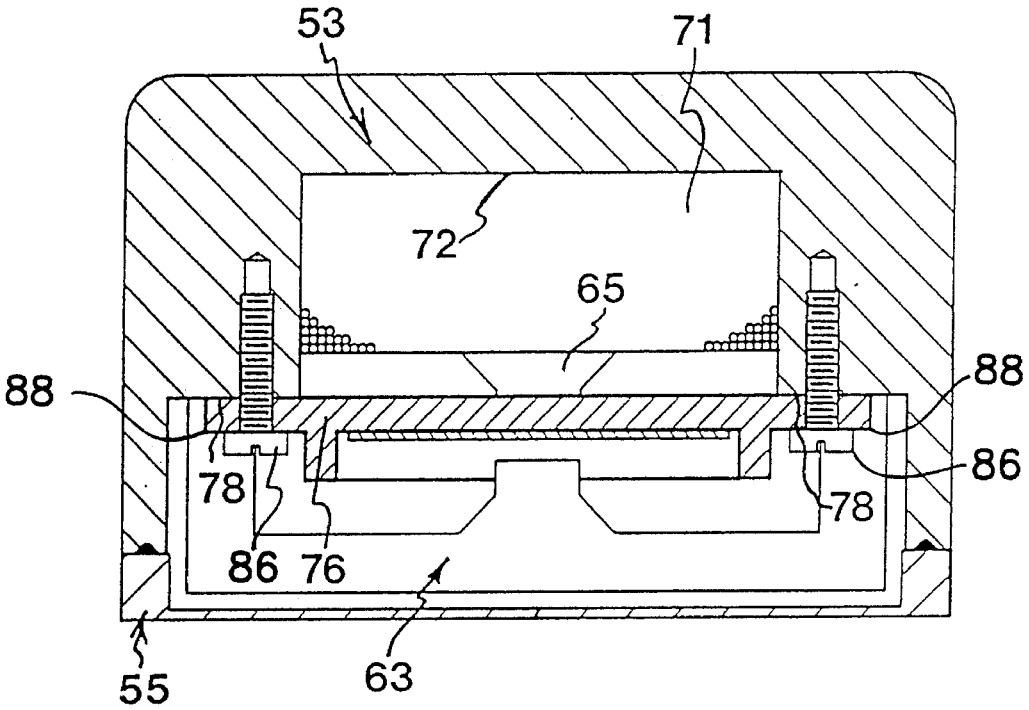
FIG. 6 is a cross-sectional view of the assembled YIG component taken along line VI—VI in FIG. 3.
Figure 8:
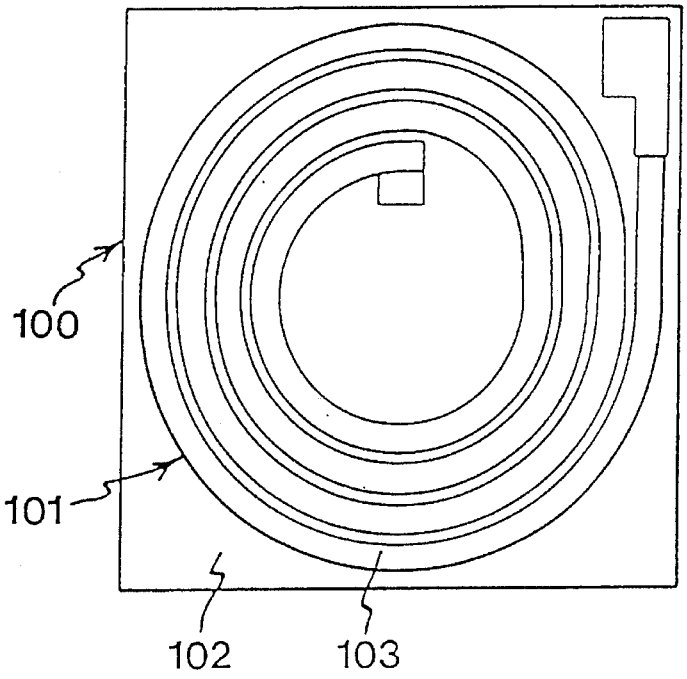
FIG. 8 is a plan view of a preferred embodiment of the modulation coil included in the YIG component.

FIGS. 2–6 disclose an embodiment of a YIG component according to the invention. This embodiment is a microwave oscillator. FIG. 2 is an exploded view of the YIG component. FIG. 3 shows the YIG component from below. An outer casing 97, 99 is removed as well as a bottom part 55. FIGS. 4–6 are cross-sectional views of the YIG component. In FIG. 6, the casing is removed. In FIG. 2, this YIG component comprises a housing 51 having a cap 53 and a bottom 55. In the bottom 55, a recess 59 is defined. In the cap 53, a first positioning seat 57 (see FIG. 4) is precision-shaped for accommodating a magnetic core 61, 63, this being a part of a magnetic circuit formed as an electromagnet. This new construction principle reduces the sensitivity to mechanical influence because the electromagnet is protected by the housing 51. Said core comprises an upper part 61 arranged in the cap 53 of the housing 51, and a lower part 63, which connects with said upper part 61. In this embodiment, the magnetic core parts 61, 63 are E-shaped and built up from elements having substantially one and the same circumference around a section transverse to the direction of the magnetic flux through the elements. The magnetic core comprises an upper pole pin 65 and a lower pole pin 67, defining an air gap or pole gap 69 (see FIGS. 4 and 5). The end of each of said pole pins 65, 67 which is directed towards the air gap 69 is tapered into a respective end part 66 and 68. The electromagnet furthermore comprises a main, or tuning, coil 71, surrounding the upper pole pin 65 and fixed to a coil seat 72 in the cap 53 (see FIG. 5), and a modulation coil 73 or Fm-coil, arranged adjacent or in the air gap 69 and being attached to either one of the pole pins 65 and 67. The modulation coil 73, may, for example, be glue-fastened onto the end surface of the lower pole pin 67. As shown in FIG. 8, said modulation coil 73 is preferably made as a printed circuit 100 in the form of a conductive pattern 101 in one or more layers provided on a very thin carrier 102, preferably having a thickness of <<0.1 mm. The printed circuit shown in FIG. 8 comprises two identically-shaped layers, one of which is arranged on the upper side of the carrier 102 and the other on its underside (not shown). The coil conductor 103, being helically arranged, is initially formed very thin and thereafter, by gold plating, brought to a thickness which is sufficient in order to fulfill the requirements of low resistance. The YIG component is further provided with a YIG unit 75, comprising a disk-shaped ceramic circuit carrier 76, which is arranged adjacent to, and fixed on, surfaces constituting a second positioning seat 78 (see FIGS. 5 and 6) in the cap 53 of the housing 51. Among other things, a ceramic circuit 79 including microwave electronics and a ferrite crystal 81 are disposed on the ceramic circuit carrier 76. The ferrite crystal 81 is then arranged on one end of a rod 83, in turn carried by a support 85. The support 85 is connected to the ceramic carrier 76. The microwave circuit 79 is electrically connected to the ferrite crystal 81 and to an output (further described below) of the YIG component, thereby constituting an interface means therebetween. A heating element (not shown) keeping the YIG-crystal 81 at a constant temperature via the support 85 is arranged on the support 85. One substantial advantage is that the new construction according to the invention has made it possible to assemble the integral parts of the YIG unit 75 into a substantially self-supporting unit. A hole 87 is formed in the ceramic circuit carrier 76. When arranging the ceramic circuit carrier 76 in the cap 53, the end part 66 of the upper pole pin 65 projects into the hole 87, which has a slightly larger diameter than the end part 66. This provides for centering of the ferrite crystal 81 in the homogeneous magnetic field in the air gap 69. For vertical alignment of the ferrite crystal 81 (see especially FIGS. 5 and 6), it is important that the first and second seats 57 and 78, respectively, are precision-machined in relation to each other. This provides for accurate positioning of the magnetic core part 61 and the carrier 76 so as to position the ferrite crystal correctly in the vertical direction in the air gap 69. The vertical distance between the seat 57 and the seat 78 is predetermined and, thus, the height of the upper part 61, the width of the air gap 69 and the vertical positioning of the ferrite crystal 81 on the carrier 76 are also predetermined. Therefore, the height of the upper part 61 and said vertical distance are preferably adjusted accurately by machining, using the same tools in the same set-up. The precision working of the housing 51, the magnetic core 61, 63, the carrier 76, and also the support 85 assures a good alignment of the ferrite crystal 81 in the homogeneous magnetic field, is not too difficult to perform by conventional technology and minimizes the need for readjustment.

FIGS. 5 and 6, as well as FIG. 3, also show the attachment of the carrier 76 to the second seat 78 of the housing 51. In this embodiment, the carrier is attached by means of four screws 86 arranged in holes in corner portions 88 of the carrier 76. The carrier abuts on the second seat 78 with said corner portions 88 and with a long side portion 90 of the carrier 76.

FIG. 6 further shows the coil seat 72 supporting the main coil 71. The coil seat 72, like the above-mentioned first and second seats 57, 78, consists of surfaces formed in the housing 51, but lack the high requirements of accuracy of the other seats.

Current/voltage connections 89 for feeding supply voltages and control currents etc. as well as a microwave output 91 are arranged in the housing 51. The high frequency output signal is obtained at the microwave output 91. The cap 53 and the bottom 55 of the housing 51 are connected by means of tubular rivets 93. A sealing ring 95 between the cap 53 and the bottom 55 provides for good sealing between the cavity of the housing 51 and the environment. The housing 51 may be enclosed by a casing 97, 99 of magnetic sheet-metal, so called μ-metal, providing a magnetic shield for minimal leakage of the magnetic field to the surroundings and elimination of external magnetic interference. This shield is much smaller and much more effective than the correspondingly arranged shield of the prior-art construction because the casing 97, 99 is not in direct contact with the magnetic core 61, 63, an extra non-magnetic gap in the form of the housing 51 being obtained between the shield 97, 99 and the magnetic core 61, 63.

The embodiment of a YIG component according to the invention as shown in FIGS. 2 and 3 operates substantially in the same way as the prior-art construction. Accordingly, current is supplied via a connection 89 to the main coil 71 for coarse adjustment of the frequency of the output signal from the component. Correspondingly, fine adjustment is obtained by means of the modulation coil 73. The current through the coil 71 generates a magnetic flux substantially following a closed loop through the magnetic core 61, 63, upwards through the lower pole pin 67 and the upper pole pin 65 via the air gap 69, sideways, downwards through side elements, inwards to the center and again upwards through the lower pole pin 67. A strong, homogeneous magnetic field is then obtained in the air gap 69, in which the ferrite crystal 81 is positioned. The ferrite crystal 81, in combination with the microwave circuit 79, generates a signal of a certain frequency which is directly related to the strength of the H-field. This signal is supplied to the output 91.

Even if the basic operating principle is the same, the new structure of the YIG component nevertheless provides for a number of operating advantages in comparison with prior-art components, beyond the great advantages of the construction as such. A substantially smaller useless magnetic flux or leakage flux is obtained by this new magnetic core construction 61, 63 in comparison with the prior-art construction. The improved performance of the new construction and the further design of the YIG component, as discussed above, allow for simplified production of a highly complicated and compact component, which is substantially smaller and has a substantially lower weight than prior-art YIG components.

The material for the housing 51 should preferably be chosen from non-magnetic metals, which allows for a choice of an easily workable, lightweight material which is nevertheless robust. Preferably, aluminum or zinc is used. However, it may be an advantage to use μ-metal, at least partially.

When the currents in the coils 71, 73 are changed in order to obtain a change of the output signal frequency, eddy currents are induced in the magnetic core 61, 63. By dimensioning the parts of the core such that each section through the material transverse to the direction of the flux therein has substantially one and the same circumference, substantially one time constant is obtained, which is explained by the fact that the eddy currents are substantially surface-related. This means that it is possible to use only one compensation network in order to obtain a short settling time. Furthermore, the low leakage flux provides for a low inductance in the main coil 71, also shortening the settling time. A further improvement may be obtained by building the magnetic core from laminates, because this will reduce said eddy currents.

The dimensions of the section of the magnetic core 61, 63 may be further decreased due to the reduced leakage flux. It is thereby possible to obtain even shorter time constants for said eddy currents.

The coil 73 has a smaller number of winding turns than conventional-type coils, which in combination with the fact that it is formed as a printed circuit 100, provides for small dimensions. The reduced number of winding turns is made possible by the miniaturized construction according to the invention with a very narrow air gap 69, because the number of winding turns is substantially proportional to the length of the air gap, as well as the new design of the coil 73, which enables positioning of the coil 73 close to the ferrite crystal 81. The conductor of the modulation coil 73 is substantially shorter than the conductor of the modulation coil in the prior art, which provides for a reduction of the eddy currents in the pole pin. This in turn leads to an enlarged bandwidth (modulation bandwidth) of the modulation coil 73. The modulation bandwidth is defined as the frequency at which the sensitivity of modulation has decreased to 71% (−3 dB) of the sensitivity at 0 Hz.

The combination of the very thin coil, the reduced number of winding turns of the coil, the narrow air gap and the fact that the coil is arranged in close vicinity to the ferrite crystal provides for a YIG component having modulation features which are significantly improved in relation to prior-art YIG components using conventionally built magnetic structures.

Figure 7:
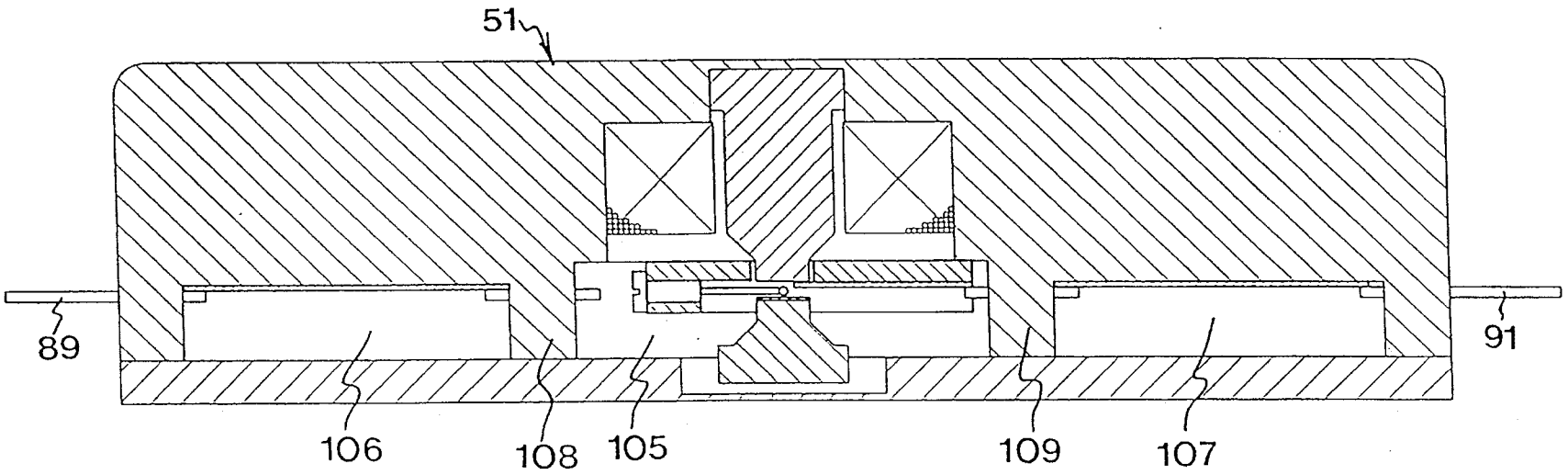
FIG. 7 is a cross-sectional view of a second embodiment of a YIG component according to the invention.

FIG. 7 shows a second embodiment of the present invention. In this embodiment, the YIG component has several cavities 105, 106 and 107, of which cavity 105 corresponds to the cavity of the first embodiment. The cavities 105–107 are separate from each other. However, in this specific embodiment, there are through holes in the walls 108 and 109 between the central cavity 105 and the cavities 106 and 107, respectively. These through holes guide conductors which connect circuitry in the side cavities 106, 107 with circuitry in the central cavity 105. In the cavity 106, which is connected to the input 89, the circuitry may, for example, be a driver. In the cavity 107, which is connected to the output 91, the circuitry may, for example, be a microwave splitter or an amplifier. The further cavities may also hold a complete YIG function means, e.g. a filter, an oscillator or a mixer, including magnetic circuits and YIG units etc. A housing having several cavities 105–107 is thus a further advantage conferred by the new construction, in that it allows for an integration of several YIG functions, such as mixers, filters etc., and/or electric functions, such as power dividers, amplifiers etc., so as to form one module. Accordingly, prior-art arrangements requiring a number of separate components having intermediate conductors can now be replaced by an arrangement with equivalent functions integrated in one and the same housing 51 in accordance with the present invention. It follows from this that an optional system may be built and enclosed in the housing 51, whereby several cavities having several magnets and/or several ferrite crystals may even be provided therein. Also other electronics for controlling and supervising YIG components, such as circuits for voltage-to-current transformation ("drivers") of a miniaturized design, may be integrated into the same housing 51.

The size of the new YIG component allows for direct integration into a subsystem unit. By this integration, the control connections are simplified because of reduced requirements for protection against interfering radiation (EMI). This also provides for a system which is substantially non-sensitive to external electric interference.

As is evident to a man skilled in the art, the embodiment which has been described above is only one example of a YIG component according to the invention and modifications may be made within the scope of the inventive idea as it is defined in the appended claims. For example, the shape of the magnetic core may be varied as long as it fulfills appropriate performances, and the same may be shaped in one piece or comprise a number of separate parts. Furthermore, the housing, the ceramic circuit carrier, etc., may of course be shaped in different ways. Instead of being an electromagnet, the magnetic circuit may be a permanent magnet in a magnetic structure or may comprise combinations of electro- and permanent magnets. In components using only one defined frequency, a permanent magnet may be used instead of the electromagnet or may constitute an integrated portion of the magnetic core of the electromagnet. The modulation coil may be shaped conventionally from a thin, insulated copper wire. In certain embodiments, interface means may be merely a transmission means.

The sealing of this new YIG component can also be made hermetic using a slightly different mechanical design.

What is claimed is:

1. A YIG component for providing a microwave frequency output signal, comprising:

a cavity comprising therein electromagnetic circuit means defining an air gap between a pair of pole pins and having a tuning coil for generating a homogeneous magnetic field in said air gap, a YIG unit comprising a carrier and at least one ferrite crystal arranged in said air gap and comprising a magnetic resonance frequency which is controllable depending on the strength of the homogeneous magnetic field; and interface means connected to said at least one ferrite crystal for providing said microwave frequency output signal;

a magnetic core included in said electromagnetic circuit means and comprising said pole pins combined with magnetic flux closing path elements shaped as bars, said pole pins and said bar-shaped elements forming an open structure;

a support housing made of a nonmagnetic material having formed therein said cavity and comprising inside said cavity integral precision-tooled surfaces for the carrying and relative positioning of said electromagnetic circuit means and said YIG unit, said surfaces comprising a first positioning seat for said magnetic core and a second positioning seat for said carrier, said core and said carrier being thus supported separately by said support housing.

2. A YIG component as claimed in claim 1, wherein said support housing further has integrally formed inside said cavity a coil seat supporting said tuning coil, and wherein one pole pin of said pair of pole pins extends through said tuning coil, said pole pin and said tuning coil being separate, thereby preventing a direct transmission of an increase of the temperature of the tuning coil, caused by a current through the tuning coil, to the magnetic core.

3. A YIG component as claimed in claim 1, wherein said interface means comprises microwave circuit means for generating said microwave frequency output signal in dependence on a magnetic resonance of said ferrite crystal.

4. A YIG component as claimed in claim 1, wherein said YIG unit carrier defines a through hole therein, and wherein one of said pole pins has an end portion projecting through said hole with a loose fit, thereby positioning said YIG unit and said ferrite crystal in a plane perpendicular to the direction of said magnetic field in said air gap.

5. A YIG component as claimed in claim 1, wherein said first seat forms an elongate groove formed in a wall of said cavity and has a portion which is raised with respect to the bottom surface of the groove and to which the magnetic core is attached, whereby a major part of the magnetic core is detached.

6. A YIG component as claimed in claim 1, wherein said carrier is disk-shaped and comprises side portions which are supported on respective parts of said second seat.

7. A YIG component as claimed in claim 1, wherein said electromagnetic circuit means further comprises a modulation coil interacting with said magnetic field for modulating the frequency of said magnetic resonance, said modulation coil comprising a printed circuit formed of a thin substrate having a spiral conductive pattern thereon, the thickness of said substrate being less than 0.05 mm.

8. A YIG component as claimed in claim 1, wherein said support housing has at least one further cavity separate from said cavity, said at least one further cavity holding a magnetic circuit and a YIG unit supported on seats formed integral with said support housing inside said at least one further cavity.

9. A YIG component as claimed in claim 1, wherein said support housing has at least one further cavity separate from said cavity by means of a wall having a through hole for passing connecting means between the cavities, said at least one further cavity holding low-frequency signal processing means.

10. A YIG component as claimed in claim 1, wherein said support housing has at least one further cavity separate from said cavity by means of a wall having a through hole for passing connecting means between the cavities, said further cavity holding microwave processing means.

11. A YIG component as claimed in claim 1, wherein said magnetic flux closing path elements and said pole pins have substantially one and the same circumference transverse to the direction of the magnetic flux therethrough.

12. A YIG component as claimed in claim 1, wherein said magnetic flux closing path elements are composed of several laminated plates.

13. A YIG component as claimed in claim 1, wherein a portion of said magnetic core defines a permanent magnet.

* * * * *